US006843505B1

(12) United States Patent
Eriksen

(10) Patent No.: US 6,843,505 B1
(45) Date of Patent: Jan. 18, 2005

(54) ASSEMBLY OF CALENDAR SHEETS IN BOOKS, RING BINDERS OR THE LIKE

(75) Inventor: Hans Eriksen, Copenhagen (DK)

(73) Assignee: Special Creation APS, Copenhagen (DK)

( * ) Notice: Subject to any disclaimer, the term of this patent is extended or adjusted under 35 U.S.C. 154(b) by 0 days.

(21) Appl. No.: 09/958,204

(22) PCT Filed: Apr. 5, 2000

(86) PCT No.: PCT/DK00/00166

§ 371 (c)(1),
(2), (4) Date: Jan. 10, 2002

(87) PCT Pub. No.: WO00/59734

PCT Pub. Date: Oct. 12, 2000

(30) Foreign Application Priority Data

Apr. 6, 1999 (DK) ..... 1999 00453

(51) Int. Cl.[7] ..... B42D 1/00
(52) U.S. Cl. ..... 281/3.1; 281/2
(58) Field of Search ..... 283/2, 3.1; D19/20, D19/21; 40/107, 109, 116, 118, 119, 120, 121

(56) References Cited

U.S. PATENT DOCUMENTS 1,866,425 A * 7/1932 Shedd
1,895,322 A * 1/1933 Hall
2,190,438 A 2/1940 Vogt
3,883,971 A * 5/1975 Weiss ..... 40/119
5,062,229 A * 11/1991 Werjefelt ..... 40/107
5,380,043 A 1/1995 Schwartz

FOREIGN PATENT DOCUMENTS

| | | |
|---|---|---|
| DE | 1 536 706 | 7/1970 |
| SE | 215 159 | 9/1967 |
| SE | 320 649 | 2/1970 |

OTHER PUBLICATIONS

JP 9052470 (Enomoto J) Feb. 25, 1997 (Abstract) Int. Publication No. WO 94/12358, David Schwartz, A windowing Book Attachment.

* cited by examiner

*Primary Examiner*—Derris H. Banks
*Assistant Examiner*—Jamila Williams
(74) *Attorney, Agent, or Firm*—Dykema Gossett PLLC

(57) ABSTRACT

The invention relates to an assembly of calendar sheets in a book, ring binder or the like wherein the sheets are kept together by means of a holder; and wherein two consecutive calendar sheets are displayed to each their side of the holder during referencing. The particular feature of the assembly of sheets constitutes in that each sheet has a front and opposite this a back that is, along a hinge line via a connecting element, pivotally connected to the holder whereby each sheet can be shifted from a plane position at the one side of the holder to a plane position at the other side of the holder during the pivoting movement of the connecting element about the hinge line and the holder.

12 Claims, 3 Drawing Sheets

Figure 1:
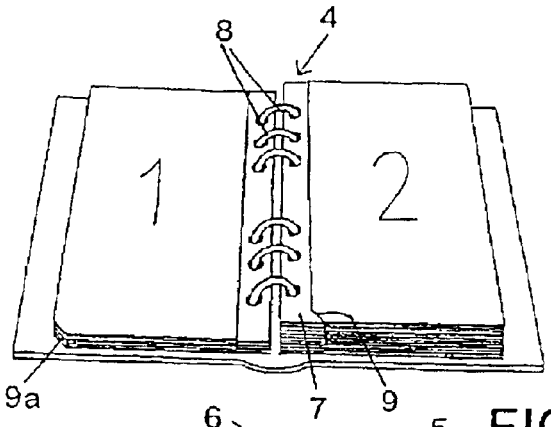
Figure 2:
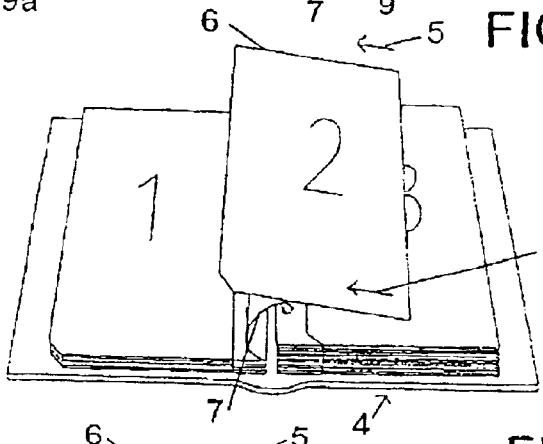
Figure 3:
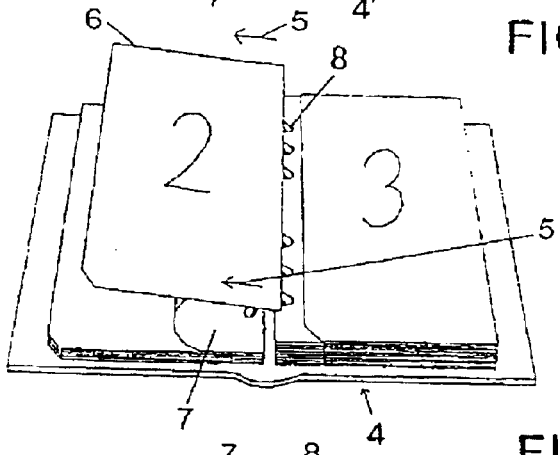
Figure 4:
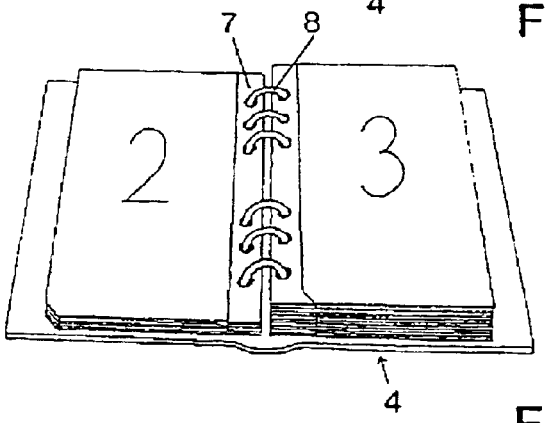

FIG. 5
1
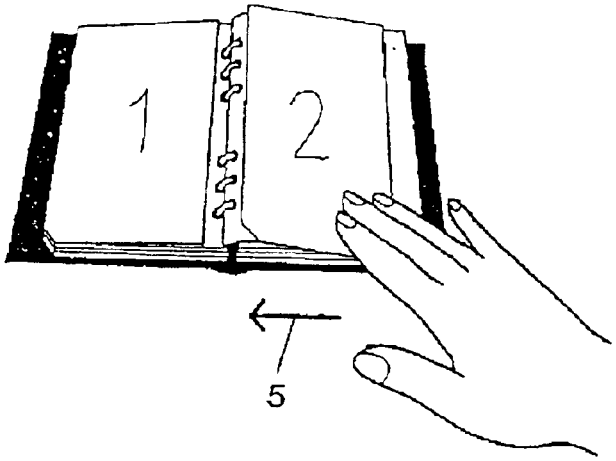
FIG. 5a
2
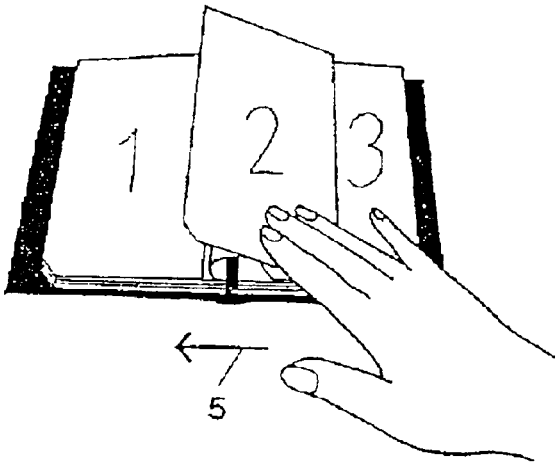
FIG. 5b
3
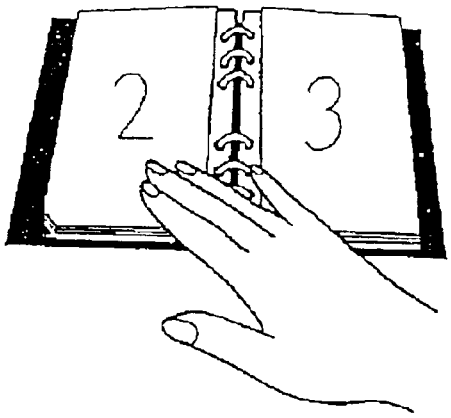
FIG. 5c

ASSEMBLY OF CALENDAR SHEETS IN BOOKS, RING BINDERS OR THE LIKE

The invention relates to an assembly of calendar sheets in a book, a ring binder or the like of the kind featured in the claims.

In such books, ring binders or spiral backs the calendar sheets are secured in the holder at a rim portion of the sheet. The holder can be the rings in a ring binder or a spiral back, or it may be constituted by gluing of rim portions of the assembly of sheets to each other, or it may be a thread stitching as is known from books. When opening such prior art sheet assembly for referencing, one sheet is displayed on each side of the holder. When a sheet is overturned, two new sheets are thus displayed: the rear side of the sheet just overturned and the front of the sheet that was previously situated below the overturned sheet. Neither of the sheets that were previously visible will now be displayed. In such prior art assemblies, it can be difficult to maintain an overview of an amount of information thus presented, and in order to maintain the overview it will thus often be necessary to turn a leaf back and forth several times.

U.S. Pat. No. 2,190,438 teaches a booklet containing two sheets that are, by means of each their connecting element, hinged to the booklet at its back, and two sheets that are, via connecting elements, hinged to the outer part of the booklet cover. During looking-up, the connecting elements permit the four sheets to be laid out side by side for display of a combined face, eg showing a road map or the like. More than four sheets can be contained in a booklet provided the width of the connecting elements is suitably increased such that all sheets can be laid out to form a combined map face. The booklet is not suitable for continuously leafing through a large number of sheets, such as eg a year calendar.

It is the object of the invention to provide a calendar that enables improved overview of a succession of time periods compared to prior art calendars.

This is obtained with a calendar of the kind described above and configured as featured in the characterising part of the claims. When the sheets are shifted successively the front pages of two abutting sheets will still face upwards when referencing is performed at that stage due to the fact that the orientation of the sheet remains unaltered. When a sheet is shifted from one side to the other side of the calendar without being overturned, notes concerning that period will continue to be on display, and a new period is exposed on the subsequent sheet. Hereby a continuous overview is maintained that is of great value especially in connection with calendars where there is always a need for planning of the most immediate future as well as the future that lies somewhat ahead.

As stated in the claims, it is an option that each sheet features, at an edge or a corner, an indicator cutout that will, upon shifting, obtain a new distance to the holder.

When a sheet is shifted from the one side to the other the indicator cutout will be moved correspondingly, and it will then be possible to use the indicator cutout to look un the relevant side. This is an obvious improvement compared to ordinary calendars that use either a system of guide cards or wherein a corner has a perforation for tearing off that corner. Both solutions are disadvantageous. The many guide cards are expensive to manufacture, and it is a frequent occurrence that the user looks up in a wrong place, and the tear-off corners cause problems in that often the user forgets to remove the tear-off corners and thereby the advantage is lost.

The configuration according to the claims wherein the hinge line is slightly shifted to the one side relative to the centre line of the sheets between the two straight edges corresponds to the indicator cutout extending along the entire periphery of each sheet. It may be advantageous to provide an indicator in this manner since in that case it is not required to perform an additional process for forming the cutout.

The connecting elements may be assembled and stitched or glued along one side, like a conventional book, but for calendars that can preferably be opened and positioned flat open on a support, the connecting members are advantageously, and as stated the claims, provided with openings for mounting in a ring binder or corresponding holder—at least in two of the sheets along the sides thereof that face away from the hinge line.

For the assembly of sheets and connecting element in paper it is found to be expedient if the sheets are made of a thicker material than the connecting element associated with each sheet, and that the connecting element is attached to the sheets at the hinge line as featured in the claims. Selection of a thin-walled material for connecting elements means that they will not contribute considerably to the aggregate thickness and weight of the assembled sheets. The attachment at the hinge line can be formed, for example, by an area of the connecting element being glued to the sheet to the right or to the left of the hinge line and has a fold that forms the hinge line as such.

A further option for manufacturing a sheet with associated connecting element consists in that, as featured in the claims, allowing the sheets and connecting elements to be folded in one and the same sheet by folding and gluing of portions of the sheet towards itself. Hereby a particularly simple configuration of sheet and connecting element is obtained.

When a calendar sheet in a calendar according to the invention changes place, the upwardly facing side will continue to turn upwards whereby information noted thereon will continue to be displayed. In case the calendar is configured for leafing by sheets being moved from the right towards the left, the user is then able to open it for reference such that the period in question is displayed on the left side, whereas the following period is shown on the right side. When transferring to the following period the right side is then moved onto the left one, whereby what is now the following period is exposed on the right side, whereas what was previously the next period and shown on the right side is now shown on the left side.

The connecting element can be a number of bands, strips, threads or a coherent sheet as long as it enables shifting of the calendar sheet from a right-hand side to a left-hand side during opening for reference without the sheet being overturned. In case strips or bands are used as connecting element, the hinge line need not be rectilinear, but for the reason of practicality a rectilinear hinge line is usually chosen. The holder can be a conventional ring binder, spiral back, or the like that secures the connecting elements along a line in such a manner that, upon opening of the calendar for reference, they can be turned from one side to the other.

The calendar sheets may be of any configuration, eg heart-shaped oval, round or multilateral. For ordinary everyday calendars ordinary rectangular sheets are conveniently used having ordinary sizes, ie elongate and configured for leafing along a longitudinally extending lateral edge.

A convenient configuration of an assembly of sheets is achieved in that at least two of the sheets have straight, substantially parallel edges; and that the hinge line extends substantially parallel with the edges; and that the connection of the connecting elements with the holder is accomplished along a line also substantially parallel with the hinge line.

Hereby a conventional assembly of calendar sheets is accomplished, like in a book with a straight back and a front that is parallel therewith, and wherein the shifting of the sheets is exclusively accomplished perpendicular to the holder.

Further advantageously, the assembly of sheets is arranged such that the hinge line for at least two of the sheets is positioned substantially at the same distance from each of the two straight edges; and that the width of the connecting element corresponds to or exceeds the longest distance between the straight edges of the corresponding sheet and the hinge line.

It is hereby ensured that the sheet can be pivoted about the hinge line to both sides without the rims of the sheet being caused to overlap the holder. The sheet assembly can thus be closed irrespectively of whether the sheet has been turned to the one or the other side relative to the connecting element.

Conveniently the connecting element has the shape of a sheet. Hereby adequate and reliable securing of the sheets in the assembly to the holder is ensured, and the sheets will be caused to be situated parallel with each other and in good order.

The sheets can be made of paper with all of the ensuing, known advantages presented by paper.

In the following an embodiment of the invention is described with reference to the drawing, wherein FIGS. 1 through 4 show a perspective view of one embodiment of the invention in the form of a calendar displayed in various successive stages of the overturning/shifting of a leaf;

FIG. 5 consisting of FIGS. 5*a* through 5*c* shows how the hand is to be moved in the turning/shifting of a leaf; and FIGS. 6 through 9 show different embodiments of the connecting element.

In FIG. 1 the calendar is displayed in its open state, and to the left the reference numeral 1 is used to designate a page having printed thereon an overview of a time period, eg a week or a month. To the right thereof a page marked 2 is situated that will, in that case, have printed thereon an overview of the following time period. FIG. 2 illustrates the page featuring the numeral 2 lifted, and on its way in the direction of the arrows 5. From this figure it will appear that the page marked 2 is the one side of a sheet 6 and that the opposite side of this sheet 6 is connected to a connecting element 7 in the form of a second sheet that is along a line hinged to the sheet 6. As will appear from FIG. 1, the sheet 7 is via holes in the edge overturnably connected to a holder that is, in the present case, constituted by a number of rings 8. As will appear from FIG. 3, the connecting element 7 is, during transfer of the sheet 6, pivoted about the hinge line relative to the sheet 6 and is also pivoted about the rings 8 of the holder. The sheet 6, however, is not overturned, but the page marked 2 remains to face upwards and if will, as will appear from FIG. 4, end on top of and cover the page marked 1.

Shifting of the sheet 6 reveals a new page and this one is marked 3. The notes made on the page marked 2 will, following shifting to expose the page marked 3, continue to be visible. Hereby an adequate overview is maintained and if the assembly of sheets is used for a book, eg a children's book, good continuity is ensured and thus the possibilities for a pedagogically suitable course are improved.

Each of the sheets has a cutout 9 as shown at a corner. Shifting of a sheet causes the cutout to change place to the opposite corner 9*a*. When the assembly of sheets is folded the cutouts 9*a* will be caused to adjoin the outwardly facing, lower corner of the sheets to the right of the holder in FIG. 1 where there are no cutouts. It is therefore easy to find the relevant place in the calendar when it is to be opened.

This is very advantageous compared to usual calendars where it is usual to configure a corner with a perforation such that the corner can readily be removed for achieving a marking of the relevant place in the calendar. It often occurs that the user forgets to remove the corner when turning each calendar leaf and thus the effect is lost. The calendar of the subject invention does not require that one remembers to remove a corner since the mere fact that the sheet changes place yields the requisite marking.

The marking may extend along an entire page along the holder, and in reality this will correspond to the hinge line between the sheet and the connecting element not being placed centrally on the sheet, but being slightly shifted to the one side.

FIG. 5 contains a consecutive series of figures, viz FIGS. 5*a* through 5*c*, wherein it is shown how the hand is moved during shifting of a leaf. The shifting occurs in the direction of the arrow 5 by the fingers exerting a light pressure onto the sheet 2 and conveying it in the direction of the arrow. Hereby the connecting element will bend slightly and turn on the rings and about the hinge line and thus be caused on abut flatly on the sheet 1 with the sheet 2 being positioned flatly thereon. During the entire shifting procedure the sheet 2 has not changed orientation and in reality it has merely been subject to parallel translation from one side of the holder to the other.

Figure 6:
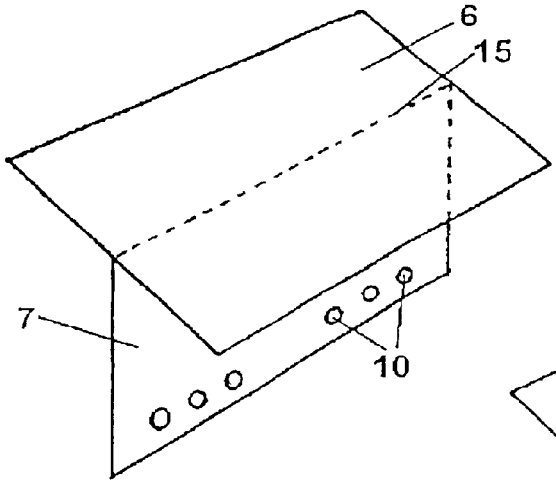
Figure 7:
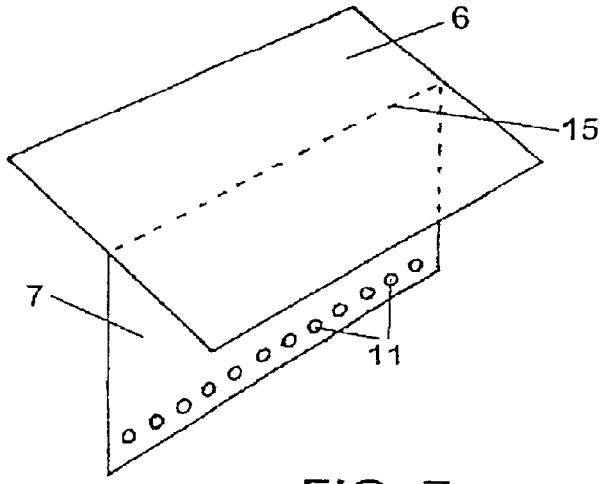
Figure 8:
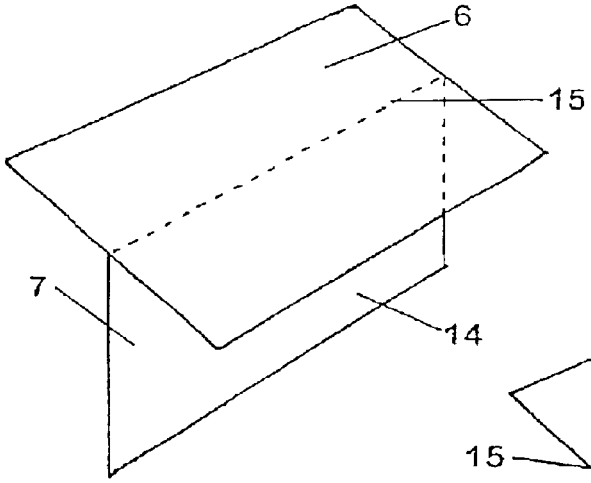
Figure 9:
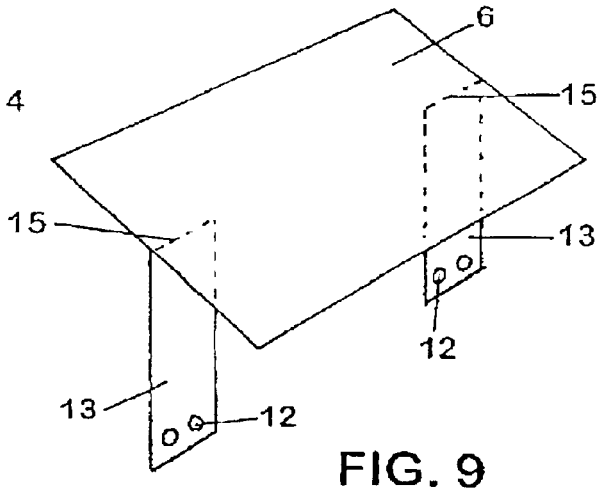

FIGS. 6 through 9 show different possible configurations of the connecting element. In FIG. 6 the lower edge of the connecting element is provided with openings 10 that make it possible to mount the element in a ring hinder, and in FIG. 7 this edge is configured with another type of openings 11 intended for insertion into a spiral back. In FIG. 8 the lower edge is smooth and in that case it may be used by gluing a number of sheets along such edge like an ordinary book. In FIG. 1 an exemplary connecting element can be seen that is not constituted by a coherent sheet, but wherein the element is, in that case, configured as two strip-shaped elements 13. Each of the elements 13 has openings 12 that allow the elements to be mounted in a holder, eg a ring binder. From FIGS. 6 through 9 the hinge line 15 marked on the top face of each sheet 6 will appear.

Of course, it is possible to print or write information on that side of the sheets that are connected to the connecting element and also the connecting element as such is able to carry information. This means that for every period in the calendar there will be space available for notes or other that by far exceeds the space occupied by the displayed overview as such of the relevant period. This further space is available by choice by overturning a sheet 6 such that it shows either that part of the back that is situated to the left of the hinge line or that part of the back that is situated to the right thereof.

What is claimed is:

1. An assembly of calendar sheets disposable in one of a book and ring binder with a view for displaying more than two sheets with overviews of successive time periods, wherein the sheets are kept together by means of a holder having sides, and wherein two consecutive calendar sheets are displayed on a respective said side of the holder during opening for reference, and wherein the calendar sheets in the assembly each has a front and a back opposite the front, wherein at its back, along a hinge line each sheet is, via respective connecting elements with generally identical widths, pivotally connected to the holder, such that each sheet is shiftable from a plane position at one said side of the holder to a plane position at an other said side of the holder during the pivoting movement of the associated connecting element about the hinge line and the holder while the orientation of each sheet is maintained.

2. An assembly of calendar sheets according to claim 1, wherein the shiftable sheets are, at an edge or at a corner, provided with a marking cutout that will, upon shifting of the sheet, be positioned at a new distance relative to the holder.

3. An assembly of calendar sheets according to claim 1, wherein the hinge line for the shiftable sheets is slightly offset to the one side relative to the centreline of the sheets between the two straight edges.

4. An assembly of calendar sheets according to claim 1, wherein the connecting elements for the shiftable sheets along the side that faces away from the hinge line is provided with the openings for mounting of the connecting elements in a ring binder or corresponding holder.

5. An assembly of calendar sheets according to claim 1, wherein the shiftable sheets are made of a thicker material than the corresponding connecting elements; and that the connecting elements are attached to the sheets at the hinge line.

6. An assembly of calendar sheets according to claim 1, wherein the shiftable sheets and the associated connecting elements are formed of one and the same sheet by folding and optionally gluing of the sheet towards itself.

7. An assembly of calendar sheets with a view for displaying more than two sheets with overviews of successive time periods, wherein the sheets are kept together by means of a holder having sides, and wherein two consecutive calendar sheets are displayed on a respective said side of the holder during opening for reference, and wherein the calendar sheets in the assembly each has a front and a back opposite the front, wherein at its back, along a hinge line each sheet is, via respective connecting elements with generally identical widths, pivotally connected to the holder, such that each sheet is shiftable from a plane position at one said side of the holder to a plane position at an other said side of the holder during the pivoting movement of the associated connecting element about the hinge line and the holder while the orientation of each sheet is maintained, and wherein the shiftable sheets are, at an edge or at a corner, provided with a marking cut out that will, upon shifting of the sheet, be positioned at a new distance relative to the holder.

8. An assembly of calendar sheets according to claim 7, wherein the shiftable sheets are, at an edge or at a corner, provided with a marking cutout that will, upon shifting of the sheet, be positioned at a new distance relative to the holder.

9. An assembly of calendar sheets according to claim 7, wherein the hinge line for the shiftable sheets is slightly offset to the one side relative to the centreline of the sheets between the two straight edges.

10. An assembly of calendar sheets according to claim 7, wherein the connecting elements for the shiftable sheets along the side that faces away from the hinge line is provided with the openings for mounting of the connecting elements in a ring binder or corresponding holder.

11. An assembly of calendar sheets according to claim 7, wherein the shiftable sheets are made of a thicker material than the corresponding connecting elements; and that the connecting elements are attached to the sheets at the hinge line.

12. An assembly of calendar sheets according to claim 7, wherein the shiftable sheets are the associated connecting elements are formed of one and the same sheet by folding and optionally gluing of the sheet towards itself.

* * * * *